US006336700B1

(12) United States Patent
Hays et al.

(10) Patent No.: US 6,336,700 B1
(45) Date of Patent: Jan. 8, 2002

(54) METHOD AND APPARATUS FOR RECOVERING AN INK DISCHARGING CONDITION OF AN INK JET RECORDING APPARATUS

(75) Inventors: Andrew W. Hays, Fairport; Robert G. Barlow; Arthur J. Sobon, both of Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/449,350

(22) Filed: Nov. 24, 1999

(51) Int. Cl.[7] ..... B41J 2/165
(52) U.S. Cl. ..... 347/35; 347/92
(58) Field of Search ..... 347/35, 20, 54, 347/55, 56, 68, 92; 438/21; 216/27; 29/890.1

(56) References Cited

U.S. PATENT DOCUMENTS 5,148,186 A * 9/1992 Torchihara et al. ..... 347/20
5,479,196 A 12/1995 Inada ..... 347/92
5,774,152 A * 6/1998 Namba et al. ..... 347/65
5,864,349 A * 1/1999 Hirabayashi et al. ..... 347/39

* cited by examiner

*Primary Examiner*—N. Le
*Assistant Examiner*—Shih-wen Hsieh
(74) *Attorney, Agent, or Firm*—Oliff & Berridge, PLC

(57) ABSTRACT

An ink jet recording apparatus includes a die reservoir and at least one ink channel in communication with the die reservoir. The method and apparatus contemplate heating ink in the die reservoir to increase vapor pressure of the ink to cause mass transfer of water vapor molecules across an interface between the air bubble and the ink and removing air bubbles entrapped within the die reservoir and the ink channel. An ink jet recording apparatus may also include a heat sink provided to the die reservoir to cool the die reservoir below predetermined threshold temperatures. The heat sink may be fixably attached to either a carriage or maintenance station of the ink jet recording apparatus, or the heat sink may be integrally formed with the die reservoir and the ink channel as part of the replacement cartridge.

39 Claims, 6 Drawing Sheets

METHOD AND APPARATUS FOR RECOVERING AN INK DISCHARGING CONDITION OF AN INK JET RECORDING APPARATUS

BACKGROUND OF THE INVENTION

1. Field of Invention

This invention relates to a method and apparatus for recovering an ink discharging condition in an ink jet recording apparatus. In particular, this invention relates to removal of unwanted air bubbles within a die reservoir and/or an ink jet channel, and also relates to maintaining the temperature of the ink jet recording apparatus within acceptable limits necessary to perform an ink jet printing or discharging operation.

2. Description of Related Art

U.S. Pat. No. 5,479,196 discloses an ink jet recording apparatus for removing air bubbles from an inkjet channel. As described in conjunction with FIGS. 4A and 4B, undesirable air bubbles are removed by utilizing film boiling or the precursor to film boiling to generate vapor bubbles which then coalesce with the offending bubble. This procedure has the disadvantage of requiring an active heating element within the die reservoir to remove air bubbles therein, which is impractical if not impossible, and in practice, it is difficult to create a series of small bubbles that coalesce. In addition, U.S. Pat. No. 5,479,196 does not teach the use of a means for regulating the temperature of the ink jet recording apparatus within acceptable limits, especially following the removal of undesirable air bubbles.

SUMMARY OF THE INVENTION

Accordingly, one aspect of the present invention is to avoid the disadvantages and shortcomings of the related art. Another object of the invention is to provide a method and apparatus in which undesirable air bubbles are removed by heating the ink in the die reservoir to increase vapor pressure of the ink to cause mass transfer of water vapor molecules across an interface between an air bubble and the ink. Another aspect of the invention relates to removal of air bubbles by enlarging them until the bubbles fill the entire die reservoir space. Subsequently, a priming vacuum applied to the channels for a short duration can be used to effectively remove the void along with air molecules within it.

Another aspect of the present invention relates to maintaining the ink jet recording apparatus within an acceptable temperature range or below a certain temperature so as to improve performance and/or reduce down time. Temperature can be maintained, for example, by providing a heat sink to the die reservoir. The heat sink may be integrally formed with the die reservoir, formed as part of the maintenance station, or formed as an integral part of the carriage which traverses a recording medium during a printing operation.

According to a first embodiment of the present invention, there is provided a method for recovering an ink discharging condition in an ink jet recording apparatus having a die reservoir and at least one ink channel in communication with the die reservoir. The method comprises heating ink in the die reservoir to increase vapor pressure of the ink to cause mass transfer of water vapor molecules across an interface between an air bubble and the ink, and removing air bubbles entrapped within the die reservoir and the ink channel.

Another aspect of the invention relates to an ink jet recording apparatus comprising a die reservoir containing ink, at least one ink channel in communication with the die reservoir and a heating element operable to heat the ink in a recording mode in which a heat-induced ink jet bubble is created to jet the ink onto a recording medium, and to heat the ink in an ink discharging condition recovery mode in which vapor pressure of the ink is increased to cause mass transfer of water vapor molecules across the interface between the ink and an air bubble remaining after the recording mode.

According to yet another preferred embodiment of the present invention, an ink jet recording apparatus comprises a die reservoir containing ink, at least one ink channel in communication with the die reservoir, a heating element operable to heat the ink in a recording mode and an ink discharging condition recovery mode, and a heat sink provided to the die reservoir to cool the die reservoir below a predetermined threshold temperature. In other preferred embodiments, the heat sink may be fixedly attached to the carriage that supports the die reservoir in the ink channel, the heat sink may be fixedly attached to a maintenance portion of the ink jet recording apparatus, and/or the heat sink may be integrally formed with the die reservoir and the ink channel.

These and other aspects and embodiments of the present invention will be described with reference to the following detailed description of preferred embodiments.

BRIEF DESCRIPTION OF THE DRAWINGS

Preferred embodiments of the invention will be described in more detail with reference to the following drawings, wherein.

DETAILED DESCRIPTION OF PREFERRED EMBODIMENTS

Figure 1:
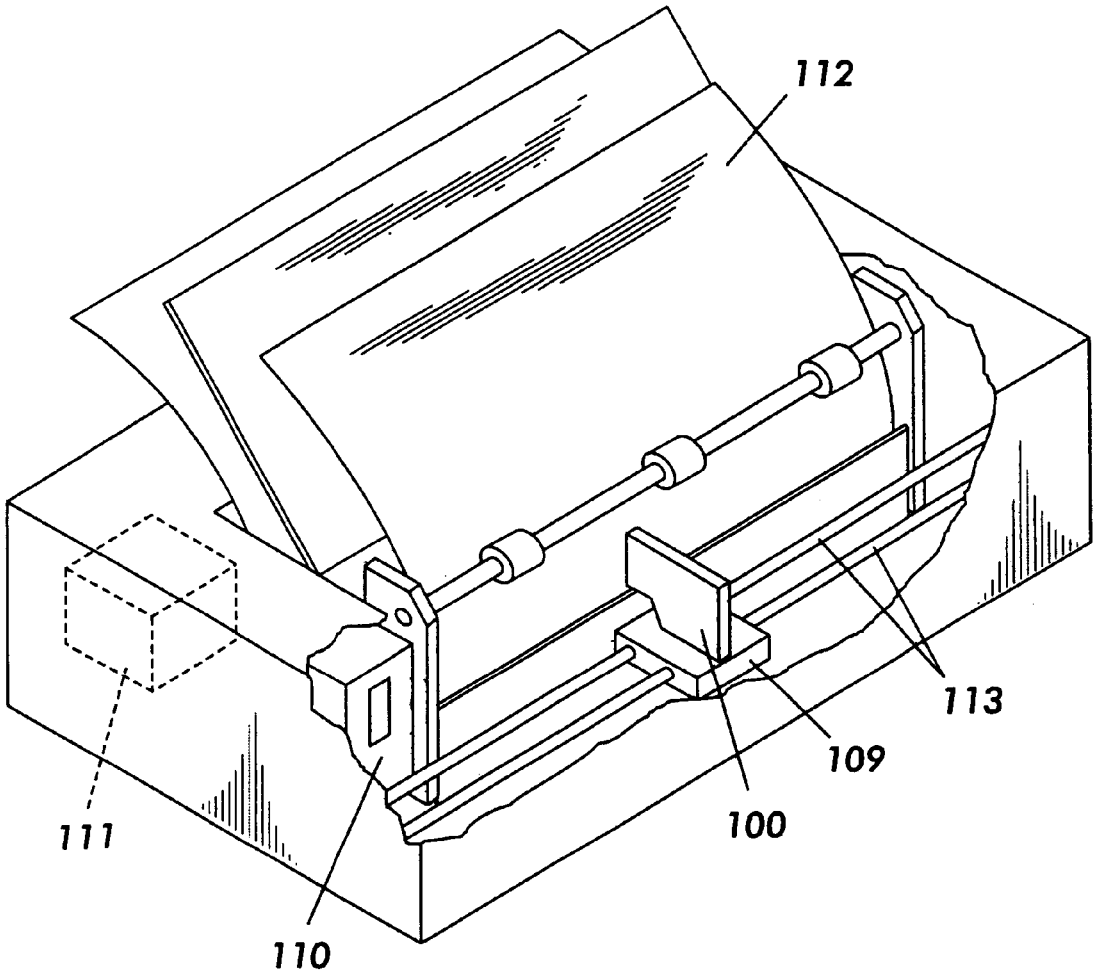
FIG. 1 is a schematic drawing illustrating the general architecture of an ink jet printing apparatus according one preferred embodiment of the present invention.

FIG. 1 shows a first preferred embodiment of the present invention. A recording head 100 is carried by a carriage 109 that is slidably mounted on one or more carriage rails 113. The recording head 100 is supplied with ink from an ink tank 111 through an ink supply tube (not shown) and discharges droplets of the ink in a predetermined timing in accordance with recording data signals. The discharged ink droplets are projected towards and received on a recording medium 112 that is being conveyed by a conveyor (not shown), whereby a desired image is formed by the ink droplets of the recording medium 112 by virtue of relative movement between the recording head 100 and the recording medium 112.

A discharge recovery device 110 or maintenance station 110 for recovering the safe discharging condition of the recording head 100 from discharge failure is provided, for example, in the vicinity of a home position of the recording head 100. The recovery device 110 may have, for example, a cap 340 (FIG. 5) capable of covering the surface of the recording head where a plurality of discharge openings open, and a pump for establishing a vacuum in the space closed by the cap 340 so as to suck the ink from the discharge openings. The cap 340 also serves to protect the discharge openings from drying and deposition of contaminants when the recording head 100 is not operating.

Figure 2:
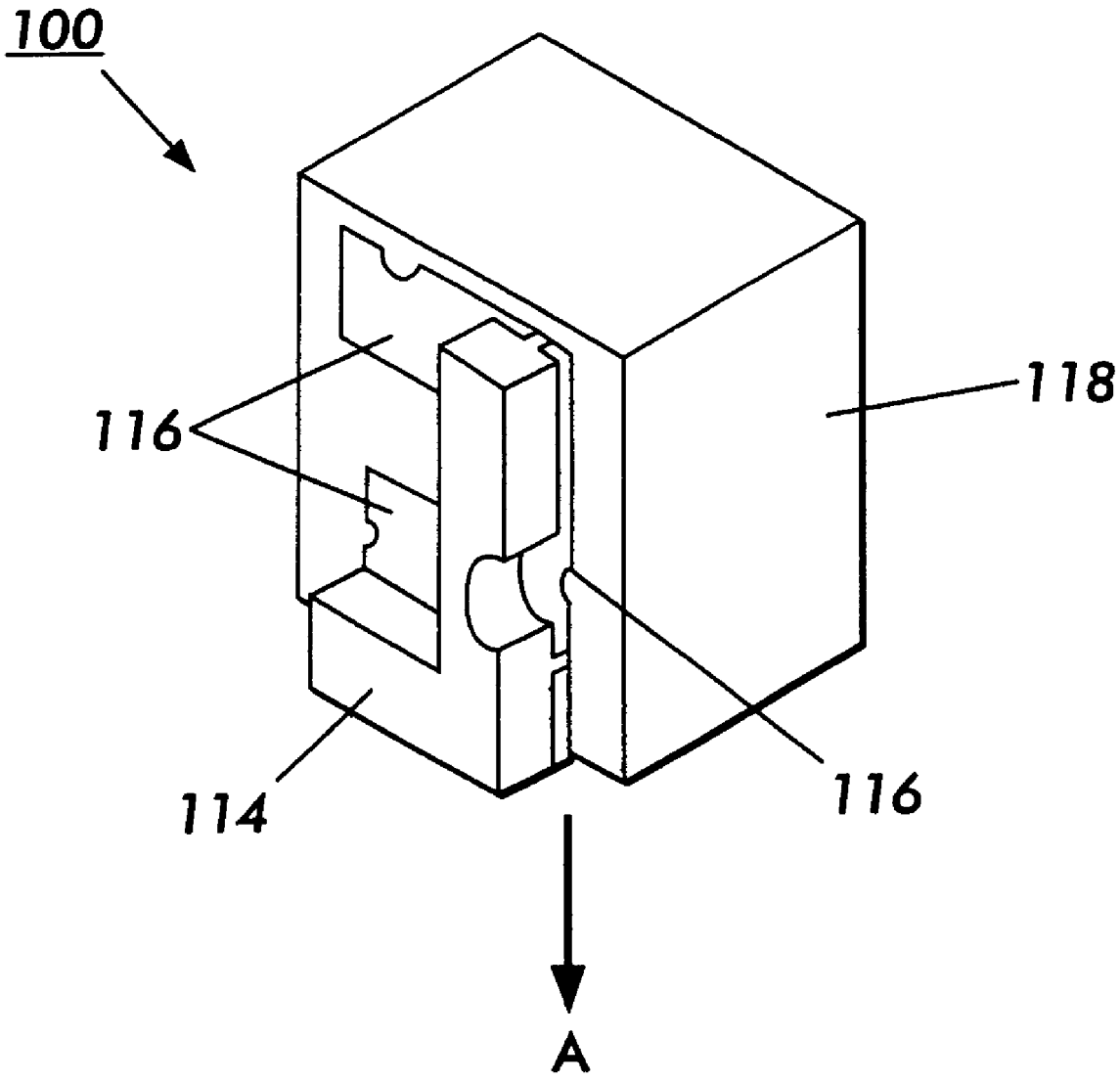
FIG. 2 is block diagram illustrating an ink jet print head according to one preferred embodiment of the present invention.

FIG. 2 is a simple block diagram showing one example of the recording head 100 according to one preferred embodiment of the invention. The recording head 100 includes a typical print manifold 114, a substrate 116 and a larger thermal mass or heat sink 118. The print manifold 114 is supplied with ink from the ink tank 111 of FIG. 1 and is positioned to deliver the ink to a die 200 (FIGS. 3A–3D), e.g., a silicon die. The die 200 includes a die reservoir 204 and at least one ink channel 201 (shown in FIGS. 3A–3D) that are connected to the bottom of the recording head 100 so as to jet ink in the direction of arrow A.

The die 200 is mounted on the substrate 116. The substrate 116 is made, for example, of a thermally conductive material such as copper and/or zinc. The substrate 116 is of low enough thermal mass to allow the temperature of the die to reach a predetermined elevated temperature, which is typically less than the boiling point of the ink, within a predetermined amount of time. The heat sink 118 is provided to rapidly cool the die and substrate 116. The heat sink 118 can be made from metal, for example.

During operation, the recording head 100 is operable in a recording mode and an ink discharging condition recovery or maintenance mode. In the recording mode, a heat induced ink jet bubble is created to jet the ink onto a recording medium, as is conventionally known in the art. For example, the ink may be superheated in order to produce ink jet bubbles that can be jetted onto the recording medium 112.

Figure 3A:
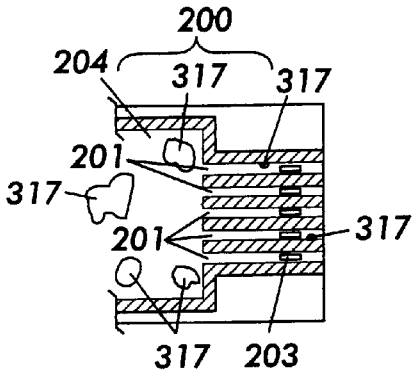
FIGS. 3A–3D illustrate a sequential process of enlarging air bubbles and applying a pressure differential across the ink channel to promote a substantially bubble free ink flow.

In the ink discharging condition recovery or maintenance mode, the recording head 100 is preferably moved to the discharge recovery device 110 (FIG. 1) when the recording head 100 moves to the home position. In this position, the process as shown in FIGS. 3A–3D can be carried out. In particular, FIG. 3A shows the die reservoir 204 and a plurality of ink channels 201 in communication with the die reservoir 204. Each ink jet channel 201 includes a heating element 203 that heats the ink in both the ink jet recording mode and the ink discharging condition recovery mode.

Figure 3B:
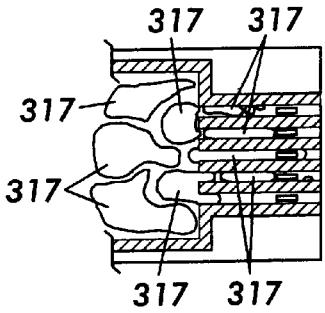

Following an ink jet operation, undesirable air bubbles 317 can form within the ink channels 201. These undesirable air bubbles can cause improper ink jet conditions, as is known in the art. In order to remove these air bubbles, the heating elements 203 heat the ink in the die reservoir 204 and/or the ink jet channels 201 to increase vapor pressure of the ink to cause mass transfer of water vapor molecules across an interface between an air bubble 317 and the ink. This causes the bubble bubbles 317 to enlarge until the enlarged bubble or bubbles 317 fill the entire space of the ink jet channels 201 and/or the die reservoir 204, as shown in FIG. 3B. Enlargement of the existing undesirable air bubbles 317 can be accomplished by heating the ink to a temperature range of between about 85° C. and the boiling point of the ink, preferably 5–10° C. below the boiling point of the ink, for a duration of time between about 10 seconds and about 30 seconds.

Figure 3C:
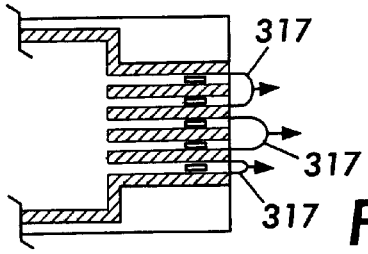
Figure 3D:
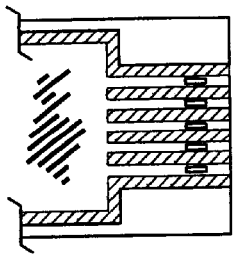

After the air bubbles enlarge to fill the entire volume of the ink jet channels 201 and/or the die reservoir 204, a conventional priming operation is applied to create a pressure differential across the ink jet channels 201 and the die reservoir 204, as shown in FIG. 3C. After the priming operation is performed, the inkjet channels 201 and the die reservoir 204 are filled with substantially bubble-free ink, as shown in FIG. 3D.

To enhance the ink discharging condition recovery process, it may be possible to decrease the surface tension of the ink by heating it by about 10° C. to help remove air bubbles from the die reservoir 204 and the ink channels 201. The decrease in surface tension causes the bubble size to increase, and the viscosity of the ink channels 201 decreases significantly which allows for larger priming flows, which in turn helps sweep the bubble forward in the die reservoir 204 causing it to be deformed into the back of the channels 201 and subsequently removed. In addition, it is noted that the vapor pressure of the ink is less than atmospheric pressure during the process.

The pressure differential across the die reservoir 204 and the ink channels 201 to induce flow of substantial bubble-free ink into the at least one channel can be applied for a duration of at least about 200 ms, and could last up to about two seconds. The pressure differential is approximately −350 mm Hg±100 mm Hg. However, the priming operation can be carried out using any appropriate pressure differential.

Figure 4:
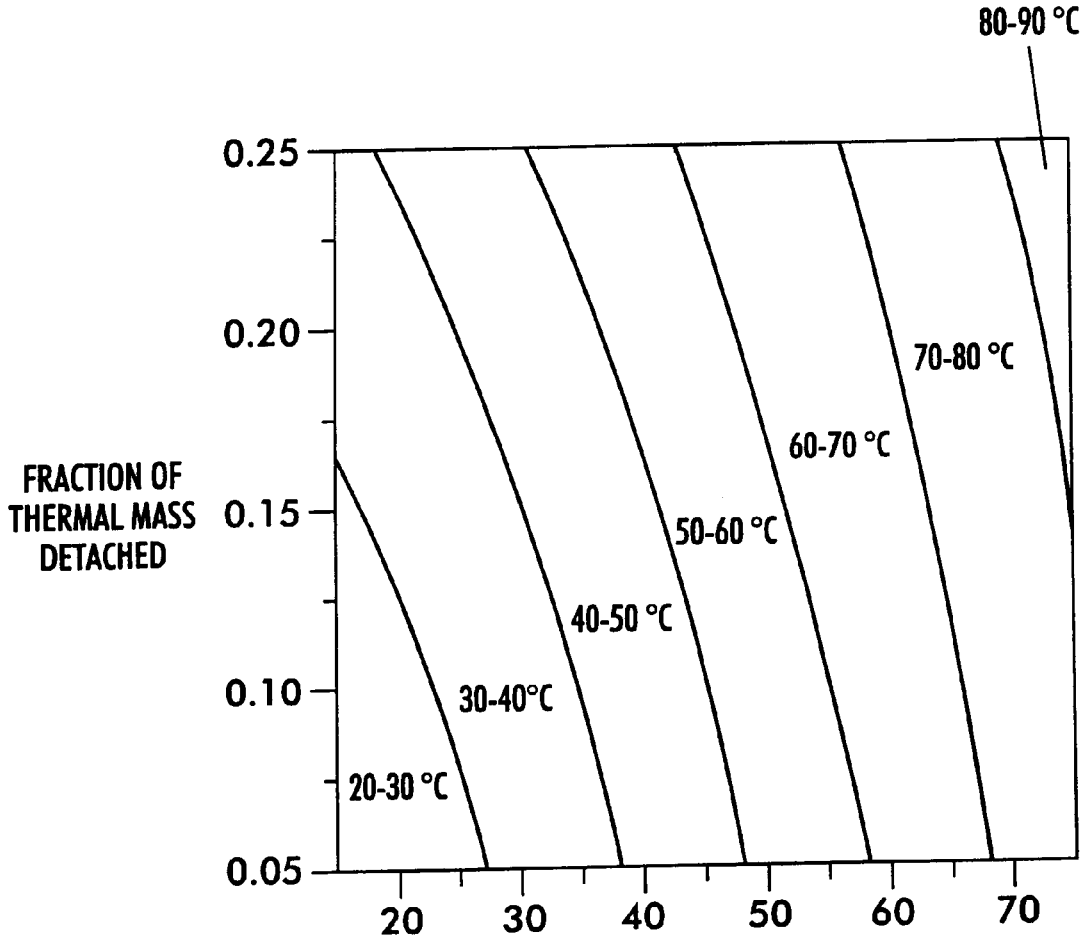
FIG. 4 is a chart illustrating the calculated final system temperature after heating the die and the substrate and then bringing the heat sink into contact with the print element.

FIG. 4 shows a graph entitled "Final temperature of total system (die, substrate, heat sink) as a function of heat sink initial temperature and thermal mass contained in the die and substrate (die and substrate at 110° C.); thermal mass of typical Xerox print head equals 2.35 cal/K)." For example, if the die 200 and the substrate 116 account for 10% of the total die/substrate/heat sink system and the die 200 and substrate 116 are heated to 110° C., when the die and the substrate 116 are attached to the heat sink 118, which is cooler, the temperature of the die and substrate 116 will decrease significantly while the heat sink 118 warms slightly. For example, if the heat sink 118 temperature is 20° C. before recombining with the hot die and substrate 116, the final equilibrium temperature would be 29° C., as shown in FIG. 4. Of course, if the heat sink 118 is initially hotter due to printing, for example 50° C., then the right side of the graph shows that the final temperature is at around 55° C., which is also shown in FIG. 4. However, if the fraction of thermal mass represented by the die and the substrate 116 is higher, the final temperature upon attachment with the heat sink 118 will be higher. This is represented by the shift of temperatures to the left as one moves vertically on the graph.

In the ink discharging condition recovery mode, one or more heating elements 203 operates in order to raise the temperature of the ink to a predetermined threshold temperature. The predetermined threshold temperature of the entire system should be between about 60° C. and 65° C. in order to allow an ink jet recording operation to be carried out properly. For example, the threshold temperature for a unit having 128 jets and a 300 dpi pitch can be reached within 10–30 seconds by providing 10 watts of power, which will heat the ink but does not jet it.

Figure 5:
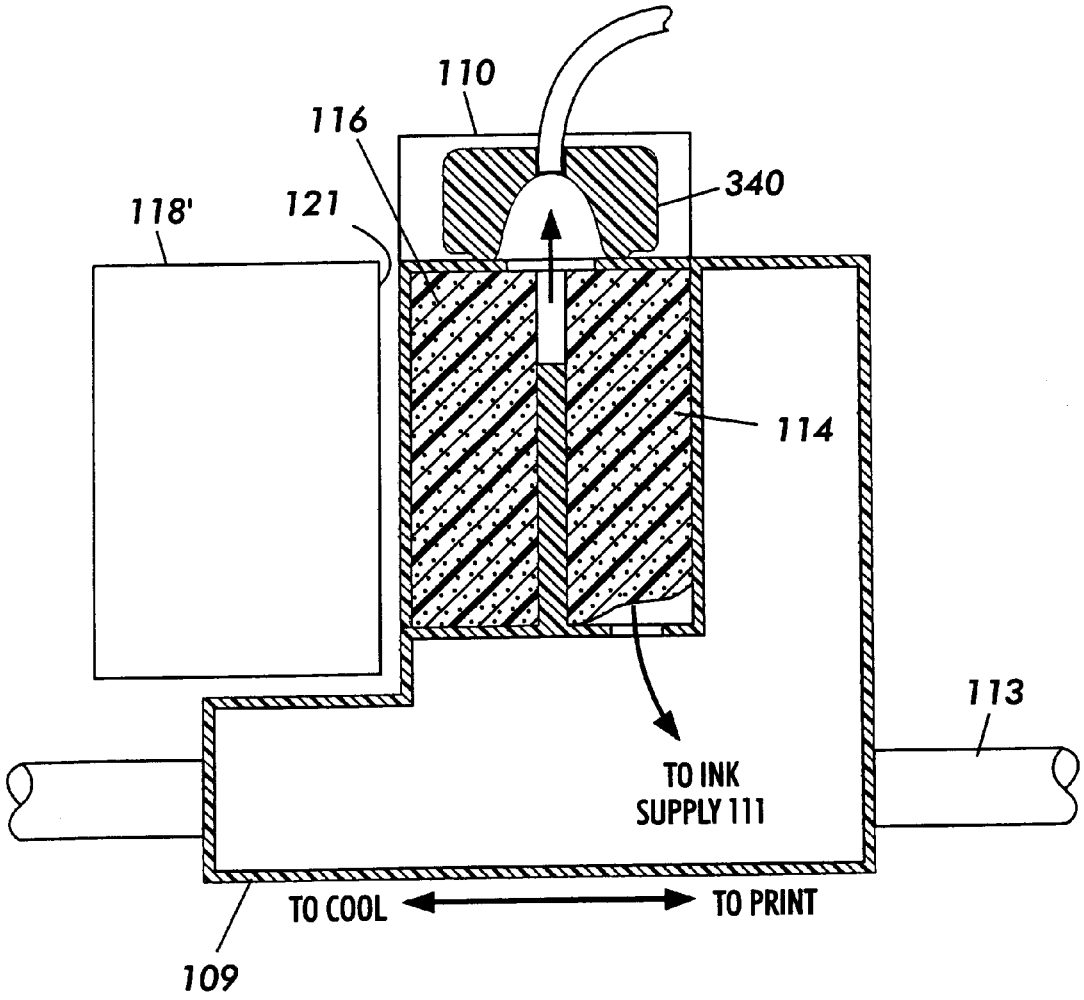
FIG. 5 illustrates a second embodiment of the present invention wherein the heat sink is provided in or near a maintenance station of an ink jet recording apparatus.

FIG. 2 shows an embodiment in which the heat sink 118 is provided as an integral part of the die reservoir 204 and the substrate 116. However, the heat sink may also be formed as part of the printing apparatus, which decreases the unit manufacturing cost because only one heat sink 118 will be provided for each printing apparatus, rather than providing a heat sink 118 for each ink jet cartridge which is sold as replacement cartridge. For example, FIG. 5 shows an embodiment in which a heat sink 118' is provided in the vicinity of the maintenance station or a discharge recovery device 110, for example, near the priming cap 340 of the maintenance station 110 (FIG. 1) such that the ink jet recording head 120 can be cooled during the maintenance process. This embodiment has the additional advantage that the motor for driving the carriage 109 can be made smaller because the weight of the heat sink 118' is not added to the load imposed upon the motor. FIG. 5 also shows that the heat sink 118' may include a very thin, compliant, thermally conductive layer 121.

Figure 6:
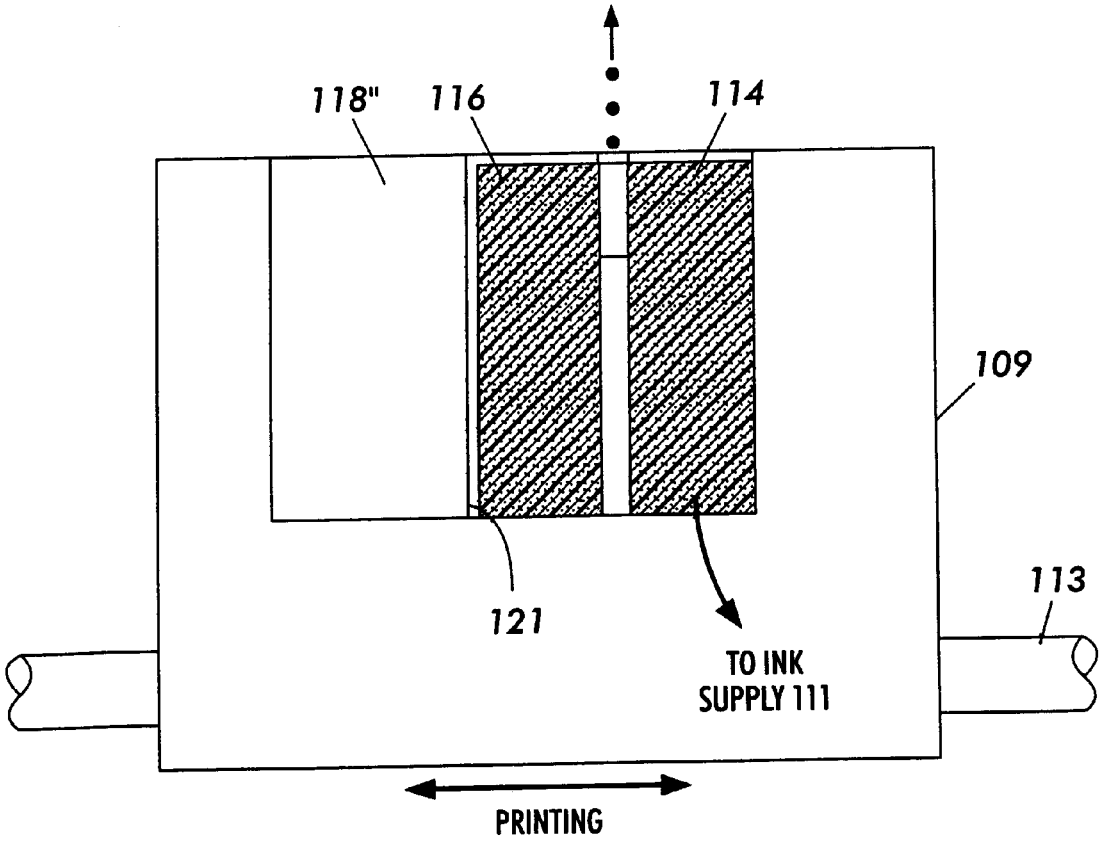
FIG. 6 illustrates a third embodiment of the present invention wherein the heat sink is connected directly to the carriage.

In another embodiment shown in FIG. 6, a heat sink 118" is provided directly on the carriage 109 such that cooling of the ink jet print head can be accomplished not only during the maintenance operation, but during the printing operation. In FIG. 6, the heat sink 118" can be coupled to the substrate 116, using, for example, magnets. In both the embodiments of FIGS. 5 and 6, it is important that the interface between the heat sink 118 and the portion of the ink jet head 100 being cooled have a proper interface such that proper thermal transfer can occur.

While the embodiments disclosed herein are preferred, it will be appreciated from these teachings that various alternatives, modifications, variations or improvements therein may be made by those skilled in the art, which are within the spirit and scope of the present disclosure.

What is claimed is:

1. A method for recovering an ink discharging condition in an ink jet recording apparatus having a die reservoir and at least one ink channel in communication with the die reservoir, the method comprising:

heating ink in the die reservoir to increase vapor pressure of the ink to cause mass transfer of water vapor molecules across an interface between an air bubble and the ink to enlarge the air bubble; and removing air bubbles entrapped within the die reservoir and the ink channel, comprising applying a pressure differential across the die reservoir and the ink channel, wherein the pressure differential is approximately −250 to −450 mm Hg and is applied for a duration of at least about 200 ms.

2. The method according to claim 1, wherein applying the pressure differential across the die reservoir and the ink channel induces the flow of substantially bubble-free ink into at least the ink channel.

3. The method according to claim 1, further comprising cooling the die reservoir below a predetermined threshold temperature by use of a heat sink attachable to the die reservoir.

4. The method according to claim 3, wherein the heat sink is permanently attached near a maintenance station of the ink jet recording apparatus so that the die reservoir may contact the heat sink when the ink jet recording apparatus is in a maintenance mode.

5. The method according to claim 3, wherein the heat sink is formed as part of a carriage that is movable with respect to a recording medium and supports the die reservoir and the ink channel.

6. The method according to claim 3, wherein the heat sink is integrally formed as part of the die reservoir.

7. The method according to claim 3, wherein the threshold temperature is between about 60° C. and 65° C.

8. The method according to claim 4, wherein a maximum allowable temperature of the heat sink depends on a fractional size of the heat sink in relation to a fractional size of the die reservoir.

9. The method according to claim 1, wherein the heating includes heating the ink in the die reservoir to a temperature that is less than a boiling point of the ink.

10. The method according to claim 1, further comprising decreasing surface tension of the ink to help remove the air bubbles from the die reservoir and the ink channel.

11. An ink jet recording apparatus, comprising:

a die reservoir containing ink;

at least one ink channel in communication with the die reservoir;

a heating element in the at least one ink channel operable to heat the ink in a recording mode in which a heat-induced ink jet bubble is created to jet the ink onto a recording medium and to heat the ink in an ink discharging condition recovery mode in which vapor pressure of the ink is increased to cause mass transfer of water vapor molecules across an interface between the ink and an air bubble remaining after the recording mode; and a heat sink provided to the die reservoir to cool the die reservoir to below a predetermined threshold temperature, the heat sink fixedly attached near a maintenance station of the ink jet recording apparatus, wherein at least the die reservoir is attachable to the heat sink when the ink jet recording apparatus is in a maintenance mode.

12. The ink jet recording apparatus according to claim 11, further comprising a substrate attached to the die reservoir.

13. The ink jet recording apparatus according to claim 11, further comprising means for decreasing surface tension of the ink to help remove air bubbles from the die reservoir and the ink channel.

14. The inkjet recording apparatus according to claim 11, further comprising a source of pressurized air that creates a pressure differential across the die reservoir and the ink channel to induce a flow of substantially bubble-free ink into at least the ink channel and removal of residual bubbles from the die reservoir and the ink channel.

15. The ink jet recording apparatus according to claim 11, wherein the predetermined threshold temperature is between about 60° C. and about 65° C.

16. The ink jet recording apparatus according to claim 11, wherein a maximum allowable temperature of the heat sink is increased if a fraction of a total thermal mass in the heat sink is increased in relation to a thermal mass of the die reservoir and substrate.

17. The ink jet recording apparatus according to claim 11, wherein the heating element heats the ink in the recording mode to a temperature above a boiling point of the ink and the heating element heats the ink in the ink discharging condition recovery mode to a temperature below the boiling point of the ink.

18. The ink jet recording apparatus according to claim 11, further comprising a pressurized air source that creates a pressure differential after the heating element heats the ink in the ink discharging condition recovery mode.

19. The ink jet recording apparatus according to claim 18, wherein the pressurized air source has a duration of at least about 200 ms.

20. The ink jet recording apparatus according to claim 19, wherein the duration is about 2 seconds.

21. An ink jet recording apparatus, comprising:

a die reservoir containing ink;

at least one ink channel in communication with the die reservoir;

a heating element in the at least one ink channel operable to heat the ink in a recording mode and an ink discharging condition recovery mode; and a heat sink provided to the die reservoir to cool the die reservoir below a predetermined threshold temperature, the heat sink fixedly attached near or within a maintenance station of the ink jet recording apparatus.

22. A method for recovering an ink discharging condition in an inkjet recording apparatus having a die reservoir and at least one ink channel in communication with the die reservoir, the method comprising:

heating ink in the die reservoir to increase vapor pressure of the ink to cause mass transfer of water vapor molecules across an interface between an air bubble and the ink to enlarge the air bubble;

removing air bubbles entrapped within the die reservoir and the ink channel;

cooling the die reservoir below a predetermined threshold temperature by use of a heat sink, wherein the heat sink is fixedly attached near a maintenance station of the ink jet recording apparatus so that the die reservoir may contact the heat sink when the ink jet recording apparatus is in a maintenance mode.

23. The method according to claim 22, wherein the removing of the air bubbles entrapped within the die reservoir in the ink channel includes applying a pressure differential across the die reservoir and the ink channel to induce the flow of substantially bubble-free ink into at least the ink channel.

24. The method according to claim 22, wherein the threshold temperature is between about 60° C. and about 65° C.

25. The method according to claim 22, wherein a maximum allowable temperature of the heat sink depends on a fractional size of the heat sink in relation to a fractional size of the die reservoir.

26. The method according to claim 22, wherein the heating includes heating the ink in the die reservoir to a temperature that is less than a boiling point of the ink.

27. The method according to claim 22 further comprising decreasing surface tension of the ink to help remove the air bubbles from the die reservoir and the ink channel.

28. An inkjet recording apparatus, comprising:

a die reservoir containing ink;

at least one ink channel in communication with the die reservoir;

a heating element in the at least one ink channel operable to heat the ink in a recording mode in which a heat-induced ink jet bubble is created to jet the ink and to a recording medium and to heat the ink in an ink discharging condition recovery mode in which vapor pressure of the ink is increased to cause mass transfer of water vapor molecules across an interface between the ink and an air bubble remaining after the recording mode; and a pressurized air source that creates a pressure differential after the heating element heats the ink in the ink discharging condition recovery mode, wherein the pressurized air source has a duration of at least about 200 ms.

29. The ink jet recording apparatus according to claim 28, wherein the duration is about 2 s.

30. The inkjet recording apparatus according to claim 28, further comprising a substrate attached to the die reservoir.

31. The inkjet recording apparatus according to claim 28, further comprising means for decreasing surface tension of the ink to help remove air bubbles from the die reservoir in the ink channel.

32. The inkjet recording apparatus according to claim 28, wherein the pressurized air source induces a flow of substantially bubble-free ink into at least the ink channel and removal of residual bubbles from the die reservoir and the ink channel.

33. The ink jet recording apparatus according to claim 28, further comprising a heat sink provided to the die reservoir to cool the die reservoir to below a predetermined threshold temperature.

34. The inkjet recording apparatus according to claim 33, wherein the heat sink is attached to a carriage that is movable with respect to a recording medium and supports the die reservoir and the ink channel.

35. The ink jet recording apparatus according to claim 33, wherein the heat sink is fixedly attached near a maintenance station of the ink jet recording apparatus, wherein at least the die reservoir is attachable to the heat sink when the ink jet recording apparatus is in a maintenance mode.

36. The inkjet recording apparatus according to claim 33, wherein the heat sink is integrally formed with the die reservoir.

37. The ink jet recording apparatus according to claim 33, wherein the predetermined threshold temperature is between about 60° C. and about 65° C.

38. The ink jet recording apparatus according to claim 33, wherein a maximum allowable temperature of the heat sink is increased if a fraction of a total thermal mass in the heat sink is increased in relation to a thermal mass of the die reservoir and substrate.

39. The ink jet recording apparatus according to claim 33, wherein the heating element heats the ink in the recording mode to a temperature above a boiling point of the ink and the heating element heats the ink in the ink discharging condition recovery mode to a temperature below the boiling point of ink.

* * * * *